US006667451B1

(12) United States Patent
Hart

(10) Patent No.: US 6,667,451 B1
(45) Date of Patent: Dec. 23, 2003

(54) PUSH BUTTON ASSEMBLY

(75) Inventor: Roy L. Hart, Laguna Niguel, CA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/393,322

(22) Filed: Mar. 20, 2003

(51) Int. Cl.[7] ..... H01H 9/16
(52) U.S. Cl. ..... 200/314; 200/308; 340/815.4
(58) Field of Search ..... 200/308–317; 340/815.4, 815.47–815.49, 815.73–815.76

(56) References Cited

U.S. PATENT DOCUMENTS

| | | | | |
|---|---|---|---|---|
| 3,315,535 A | | 4/1967 | Stevens | 74/100 |
| 3,602,677 A | * | 8/1971 | Adelson et al. | 200/283 |
| 4,359,618 A | * | 11/1982 | Stevens | 200/314 |
| 4,496,813 A | | 1/1985 | Fukushima | 200/314 |
| 4,563,592 A | * | 1/1986 | Yuhasz et al. | 307/115 |
| 5,296,826 A | | 3/1994 | Hart et al. | 335/132 |
| 5,659,297 A | | 8/1997 | Tatavoosian | 340/815.4 |
| 6,153,841 A | | 11/2000 | Hart | |

* cited by examiner

*Primary Examiner*—Michael A Friedhofer
(74) *Attorney, Agent, or Firm*—Tarolli, Sundheim, Covell & Tummino L.L.P.

(57) ABSTRACT

An improved push button assembly having solid state light sources may be utilized to replace push button assemblies having incandescent light sources in previously installed switch assemblies or may be used in original equipment. The push button assembly includes a base which at least partially encloses a printed circuit. A plurality of solid state light sources are connected with the printed circuit. A display is illuminated by light from the solid state light sources. One or more electrical circuit components, which emit heat, are connected with the printed circuit. A metal heat sink is disposed adjacent to the electrical circuit components. The metal heat sink engages a metal housing which encloses a display which is illuminated by light from the solid state light sources.

39 Claims, 7 Drawing Sheets

PUSH BUTTON ASSEMBLY

BACKGROUND OF THE INVENTION

The present invention relates to a new and improved push button assembly and to a manner in which heat is transferred from the push button assembly.

Push button switch assemblies have previously utilized incandescent light sources to illuminate displays. Push button switch assemblies having such a construction are disclosed in U.S. Pat. Nos. 3,315,535 and 4,496,813. However, push button switch assemblies having incandescent light sources may require maintenance to replace failed or burnt out light sources.

It has been suggested that solid state light sources may be utilized to illuminate a display in a push button switch assembly. Known push button switch assemblies having solid state light sources to illuminate displays are disclosed in U.S. Pat. Nos. 5,659,297 and 6,153,841. When circuit components which emit heat are disposed adjacent to the solid state light sources, there is a possibility that the light sources may tend to overheat.

SUMMARY OF THE INVENTION

The present invention relates to a new and improved push button assembly which is used to move switch contacts between an actuated condition and an unactuated condition. The push button assembly includes a plurality of solid state light sources which are energizable to emit light. A display is illuminated by light from the solid state light sources when the solid state light sources are energized.

A metal heat sink is disposed adjacent to electrical circuit components which emit heat. To conduct heat away from the heat sink, the metal heat sink may be disposed in engagement with a metal housing. The heat sink may be formed by a single member or by a plurality of members. The member or members forming the heat sink may advantageously have projections which extend through side walls of a base. The projections are engagable by the metal housing to facilitate the conduction of heat between the heat sink and the housing.

BRIEF DESCRIPTION OF THE DRAWINGS

The foregoing and other features of the invention will become more apparent upon a consideration of the following description taken in connection with the accompanying drawings wherein.

DESCRIPTION OF A SPECIFIC PREFERRED EMBODIMENTS OF THE INVENTION

Push Button Assembly

Figure 1:
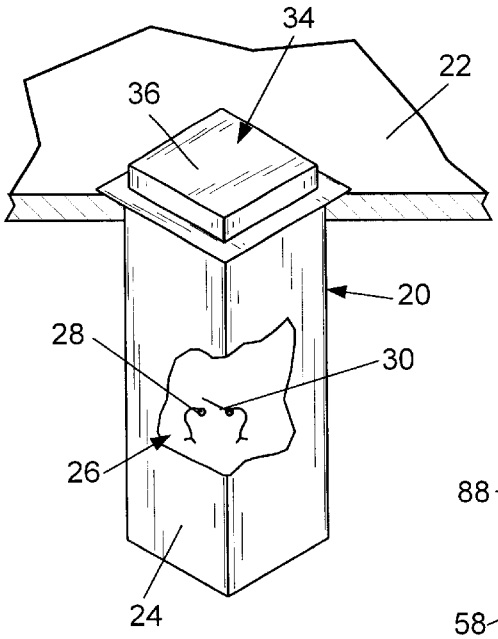
FIG. 1 is a schematic illustration of a switch assembly which is connected with a control panel.
Figure 2:
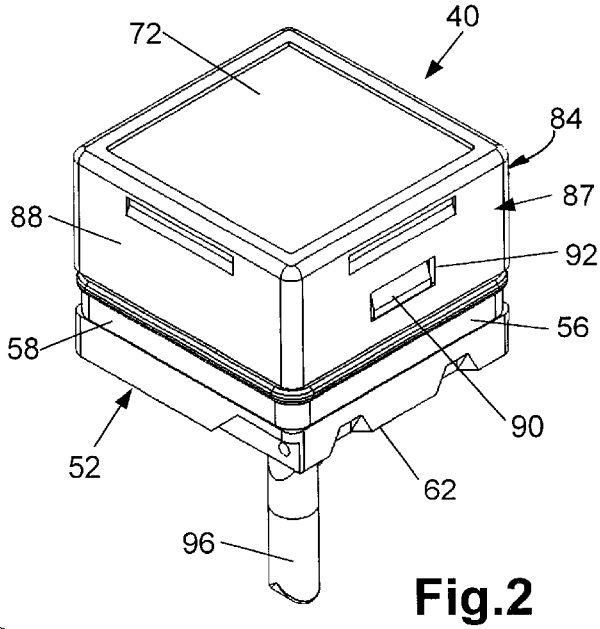
FIG. 2 is an enlarged upper pictorial view of a push button assembly which is constructed in accordance with the present invention and which may be used in the switch assembly of FIG. 1 to move switch contacts between actuated and unactuated conditions.

The manner in which a push button switch assembly 20 is installed in a control panel 22 of a vehicle, such as an aircraft, is illustrated schematically in FIG. 1. The known push button switch assembly 20 includes a push button assembly 34. The push button assembly 34 includes a display 36 which is illuminated by incandescent light sources (not shown) in response to actuation of the push button switch assembly and/or an occurrence at a remote location. The occurrence at a remote location may be either the operation of a device or the failure of a device to operate.

The push button assembly 20 has a known construction which includes a housing 24. The housing 24 encloses a switch assembly 26. The switch assembly 26 includes a stationary contact 28 and a movable contact 30. Although the push button switch assembly 20 is disposed in an aircraft, it is contemplated that the push button switch assembly may be utilized in other types of vehicles, such as land or water based vehicles. Alternatively, the push button switch assembly may be associated with a control panel for equipment in a factory.

The push button switch assembly 20 has a construction similar to the construction disclosed in U.S. Pat. Nos. 3,315,535 and/or 5,296,826. The disclosures in the aforementioned U.S. Pat. Nos. 3,315,535 and 5,296,826 are hereby incorporated herein in their entirety by this reference thereto. The push button switch assembly 20 is a series 584, Four Pole Lighted Push Button Switch which is commercially available from Eaton Corporation, Aerospace Controls Division, Costa Mesa, Calif.

It is contemplated that it may be desired to improve the push button switch assembly 20 by replacing the push button assembly 34 with an improved push button assembly 40 (FIGS. 2–5). The improved push button assembly 40 includes solid state light sources 42 (FIG. 4) which are disposed on a light source board 44. The solid state light sources 42 and light source board 44 are connected with a flexible printed circuit 46. A plurality of electrical circuit components 48 are connected with the printed circuit 46.

Figure 6:
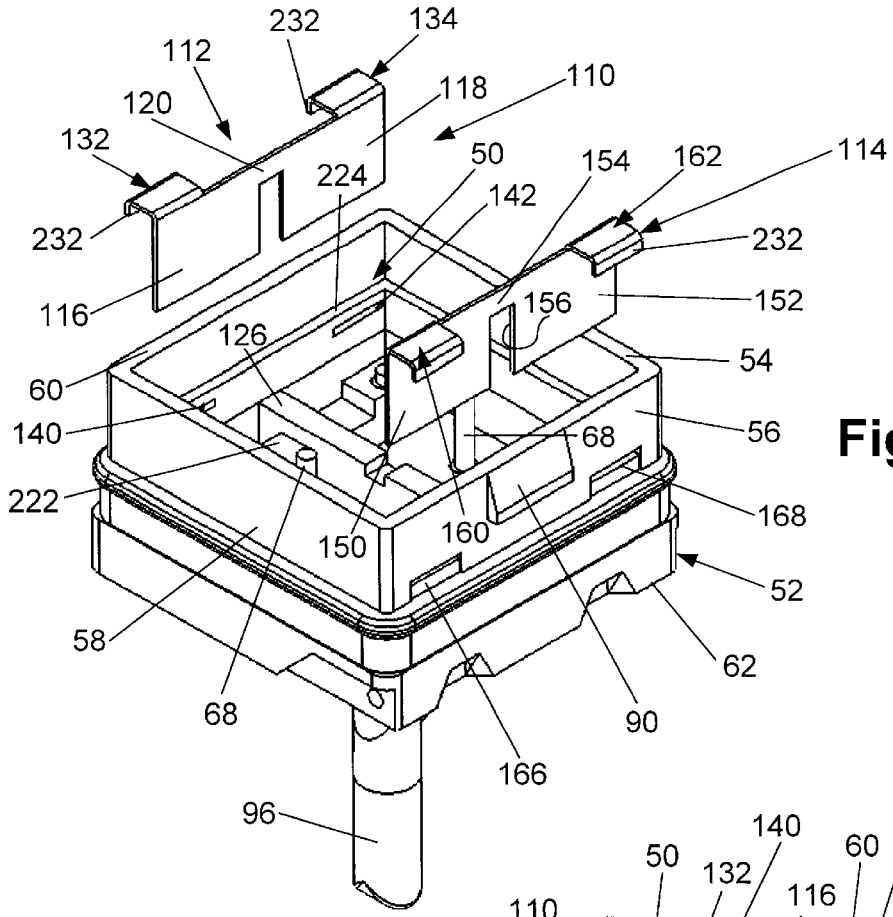
FIG. 6 is an enlarged upper pictorial view of a heat sink and a base of the push button assembly of FIGS. 2 and 3 prior to installation of the heat sink in the base.
Figure 7:
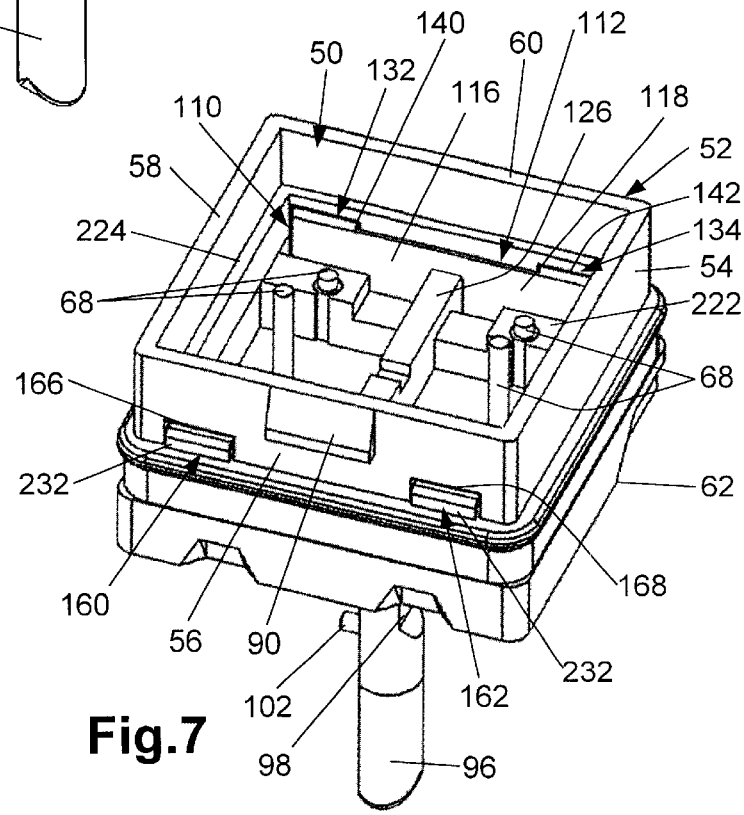
FIG. 7 is an upper pictorial view of the base of the push button assembly with the heat sink installed, the base of the push button assembly being offset by approximately 90 degrees from the orientation illustrated in FIG. 6.

The solid state light sources 42, light source board 44, printed circuit 46, and electrical circuit components 48 are all received in a recess 50 (FIGS. 4, 6 and 7) in a base 52. The recess 50 has a general rectangular configuration and is formed by side walls 54, 56, 58 and 60 which extend upward from a bottom wall 62. The base 52 is molded of a suitable electrically insulating polymeric material. Metal terminals 68 (FIGS. 3–7) extend through the base 52 into the recess 50 (FIG. 7).

The solid state light sources 42 (FIG. 4) are energizable to illuminate a display 72. When the display 72 is illuminated, it is clearly visible to an individual adjacent to the push button assembly 40. The specific construction of the display 72 will depend upon the environment in which the push button assembly 40 is to be used. However, it is contemplated that the display 72 may have a construction similar to the construction disclosed in U.S. Pat. Nos. 5,295,050; 5,544,019; 5,659,297; 5,820,246; 5,913,617; and/or 5,951,150. It should be understood that the display 72 may have any desired construction and may include indicia which becomes visible when the solid state light sources 42 are energized to illuminate the display.

A divider 76 is provided to direct light from groups of the solid state light sources 42 onto specific areas of the display 72. In addition to directing the light from the light sources 42 towards predetermined areas on the display 72, the divider 76 functions as a reflector to maximize the intensity of the light which is directed onto a particular portion of the display 72. A gasket 80 (FIG. 5) is provided between the divider 76 and the display 72 to block leakage of light from the push button assembly 40.

Figure 4:
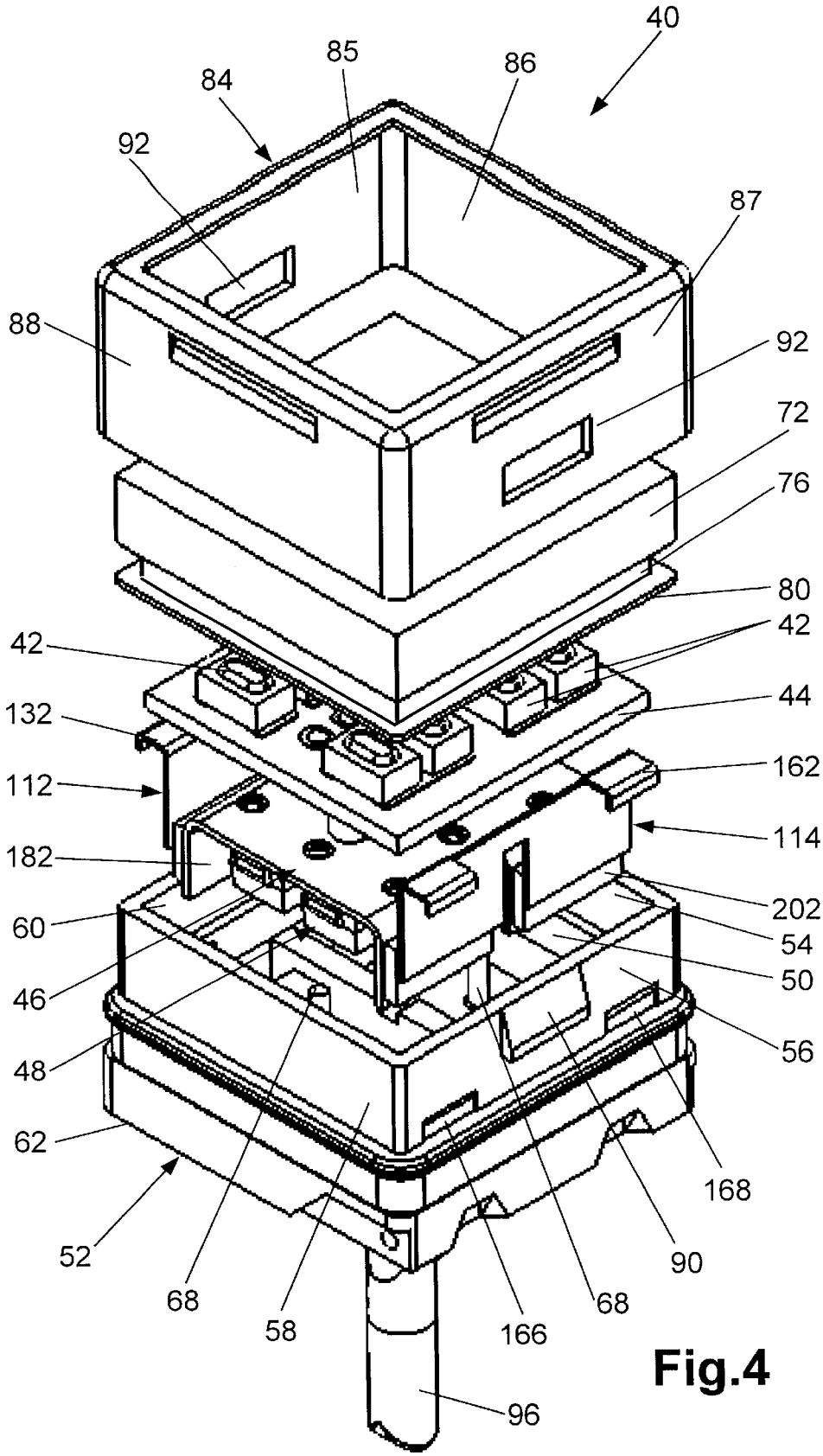
FIG. 4 is an exploded upper pictorial view of the push button assembly of FIGS. 2 and 3.

A metal housing 84 is provided to enclose the display 72. The metal housing 84 has flat metal side walls 85, 86, 87, and 88 (FIG. 4). The side walls 54–60 on the base 52 are partially enclosed by the metal side walls 85–88 of the housing 84. Thus, the side walls 54–60 on the base 52 are telescopically enclosed by the side walls 85–88 on the housing 84.

A pair of identical retainers 90 are integrally formed as one piece with the side walls 56 and 60. Although only the retainer 90 connected with the side wall 56 is illustrated in FIGS. 4–7, it should be understood that a similar retainer is integrally formed as one piece with the side wall 60. The retainers 90 snap into rectangular openings 92 (FIGS. 4 and 5) formed in the housing 84.

A cylindrical actuator or plunger 96 extends downward (as viewed in FIGS. 2–7) from a center of the base 52. The actuator 96 has a recess 98 (FIG. 7) which is engaged by a resilient retainer rod or wire to hold the actuator in the housing 24 (FIG. 1) in a known manner. A pin 102 (FIG. 7) extends from the actuator 96 and transmits force from the actuator in the same manner as is disclosed in U.S. Pat. No. 5,296,826.

When the improved push button assembly 40 is to be substituted for the known push button assembly 34 in the push button switch assembly 20 of FIG. 1, the push button assembly 34 is pulled straight upward (as viewed in FIG. 1) from the housing 34. As this occurs, a resiliently deflectable wire or rod which engages a recess, corresponding to the recess 98 of FIG. 7, in an actuator (not shown) is deflected. As this occurs, the known push button assembly 34 (FIG. 1) is pulled from the switch assembly 20 without disconnecting the switch assembly from the panel 22 in which the housing is mounted.

The improved push button assembly 40 is then moved downward (as viewed in FIGS. 2 and 3) into the housing 40. The push button assembly 40 has the same outside dimensions as the push button assembly 34. In addition, the recess 98 (FIGS. 5 and 7) in the actuator 96 on the push button assembly 40 cooperates with the resilient pin or wire in the housing 24 in the same manner as does the push button assembly 34. Therefore, the push button assembly 40 can be moved into the housing 24 without disconnecting the housing 24 and/or switch assembly 26 from the control panel 22. This facilitates replacement of the known push button assembly 34 with the improved push button assembly 40.

Heat Sink

The electrical circuit components 48 (FIGS. 4, 5 and 8) in the improved push button assembly 40 emit heat when they are energized by electrical energy. The heat which is emitted by the electrical circuit components 48 may tend to result in overheating of the solid state light sources 42 (FIG. 4) in a manner which would be detrimental to their operation.

In accordance with one of the features of the push button assembly 40, a heat sink 110 (FIG. 6) is provided in the push button assembly 40. The heat sink 110 includes first and second identical metal sections 112 and 114. The first and second sections 112 and 114 are disposed on opposite sides of the recess 50 in the base 52.

The first section 112 of the heat sink 110 is mounted in engagement with the side wall 60 (FIG. 7) of the base 52. The second section 114 (FIG. 6) of the heat sink 110 is mounted into engagement with the side wall 56 of the base 52. The first and second sections 112 and 114 of the heat sink 110 are positioned in a parallel relationship with each other by engagement with the parallel side walls 56 and 60 of the base 52.

The first section 112 of the heat sink 110 is integrally formed from a single piece of sheet metal. The first section 112 of the heat sink 110 includes a pair of flat rectangular metal panels 116 and 118. The panels 116 and 118 are interconnected by a connector 120. A slot 122 is disposed between the panels 116 and 118 and receives an inner wall 126 disposed in the recess 50 in the base 52 (FIGS. 6 and 7). The inner wall 126 extends between and is perpendicular to the side walls 56 and 60 of the base 52.

The first section 112 of the heat sink 110 (FIG. 6) includes a pair of projections 132 and 134 which extend from the panels 116 and 118. The metal projections 132 and 134 extend through a pair of slots 140 and 142 in the side wall 60 (FIG. 7). The projections 132 and 134 (FIG. 6) have a generally hook shaped configuration and extend through the slots 140 and 142 and in a downward direction along an outer surface of the side wall.

The second section 114 of the heat sink 110 has the same construction as the first section 112. The second section 114 of the heat sink 110 is integrally formed from a single piece of sheet metal. The second section 114 of the heat sink 110 includes flat metal panels 150 and 152 (FIG. 6) which correspond to the panels 116 and 118 on the first section 112 of the heat sink 110. The panels 150 and 152 are interconnected by a connector section 154. A slot 156 receives a portion of the inner wall 126.

A pair of projections 160 and 162 extend from the panels 150 and 152. The metal projections extend through slots 166 and 168 in the side wall 56 (FIG. 6). The projections 160 and 162 have a generally hook shaped configuration and extend downward (as viewed in FIG. 7) along the outer surface of the side wall 56. The projections 132 and 134 from the first section 112 of the heat sink 110 extend downward along the outer surface of the side wall 60 in the same manner as the projections 160 and 162 from the second section 114 of the heat sink 110 extend downward along the outer surface of the side wall 56 (FIG. 7).

The first and second sections 112 and 114 of the metal heat sink 110 are positioned relative to the recess 50 and the base 52 by engagement of the slots 122 and 156 with the inner wall 126 (FIG. 7) of the base. The first section 112 of the heat sink 110 is also positioned relative to the recess 50 and base 52 by engagement of the projections 132 and 134 with the slots 140 and 142 in the side wall 60 of the base.

Similarly, the second section 114 of the heat sink 110 is positioned relative to the recess 50 by engagement of the projections 160 and 162 with the slots 166 and 168 in the side wall 56 of the base (FIG. 7).

The heat sink 110 includes two separate sections or pieces 112 and 114 which are disposed on opposite sides of the recess 50. However, the heat sink 110 could be formed by a lesser or greater number of pieces if desired. For example, the heat sink 110 could be formed as a single piece of metal having sections along opposite sides of the recess 50 interconnected by a section extending along the bottom of the recess. Alternatively, the heat sink 110 may be formed by four separate metal sections, each of the sections being disposed along one of the side walls 54, 56, 58, and 60 of the base 52.

Printed Circuit

The printed circuit 46 (FIG. 8) is flexible. The printed circuit 46 includes a flat main section 180. A plurality of secondary sections 182, 184, 186 and 188 extend downward from and are perpendicular to the main section 180. The printed circuit 46 contains conductors which are enclosed in a suitable electrically insulating polymeric material in a well known manner. Although the printed circuit 46 is flexible, it has sufficient rigidity to maintain the configuration illustrated in FIG. 8 once the printed circuit has been bent to this configuration.

Figure 3:
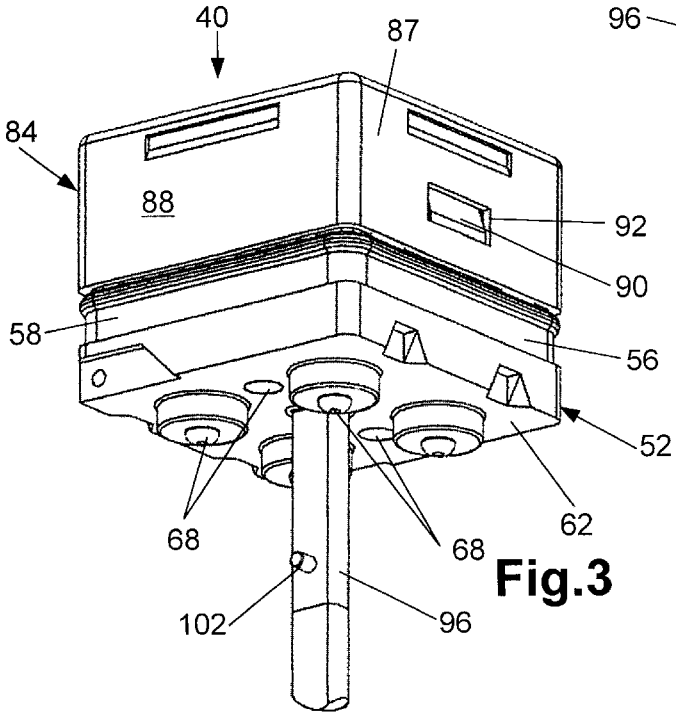
FIG. 3 is a lower pictorial view of the push button of FIG. 2.
Figure 5:
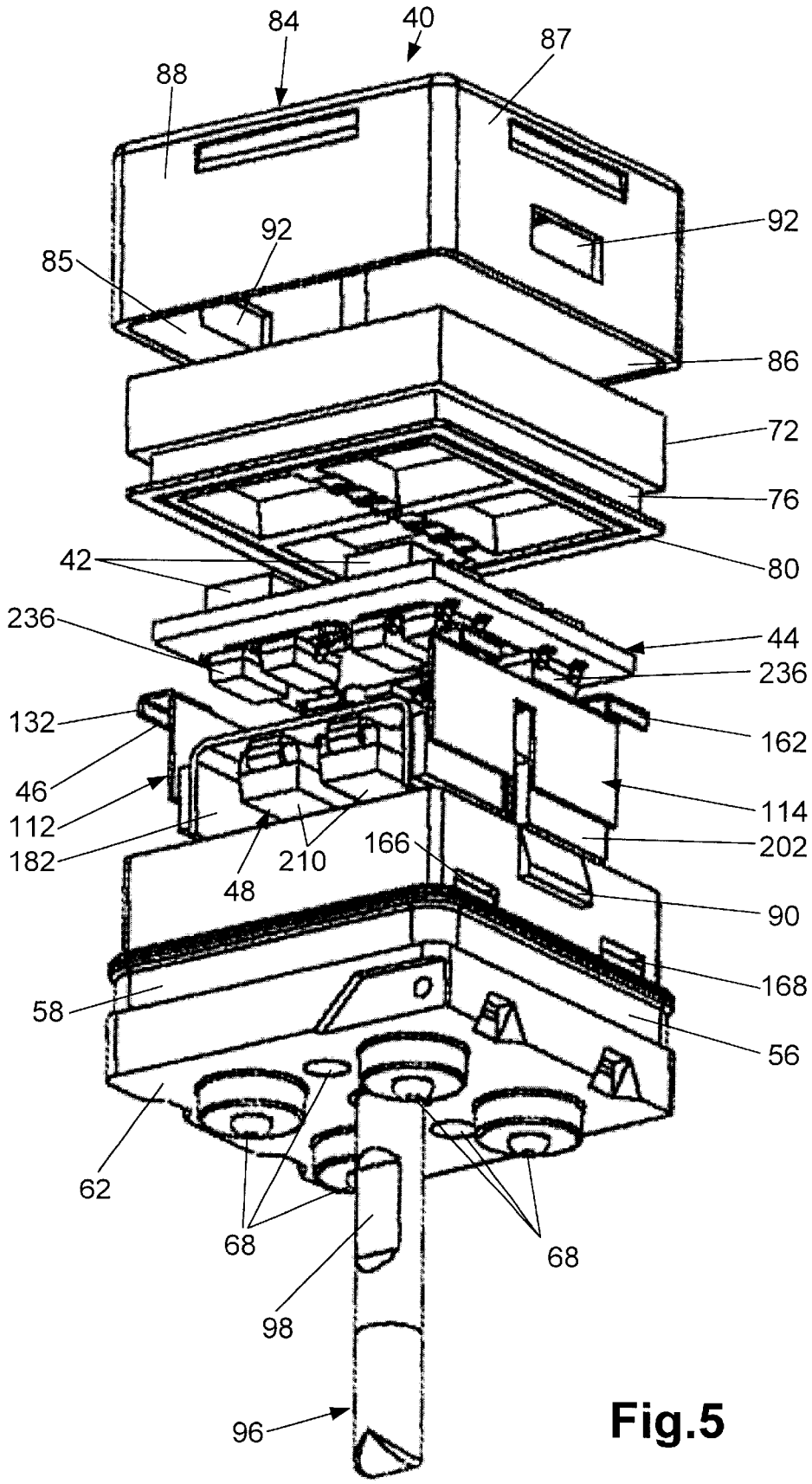
FIG. 5 is an exploded lower pictorial view of the push button assembly of FIGS. 2 and 3.
Figure 8:
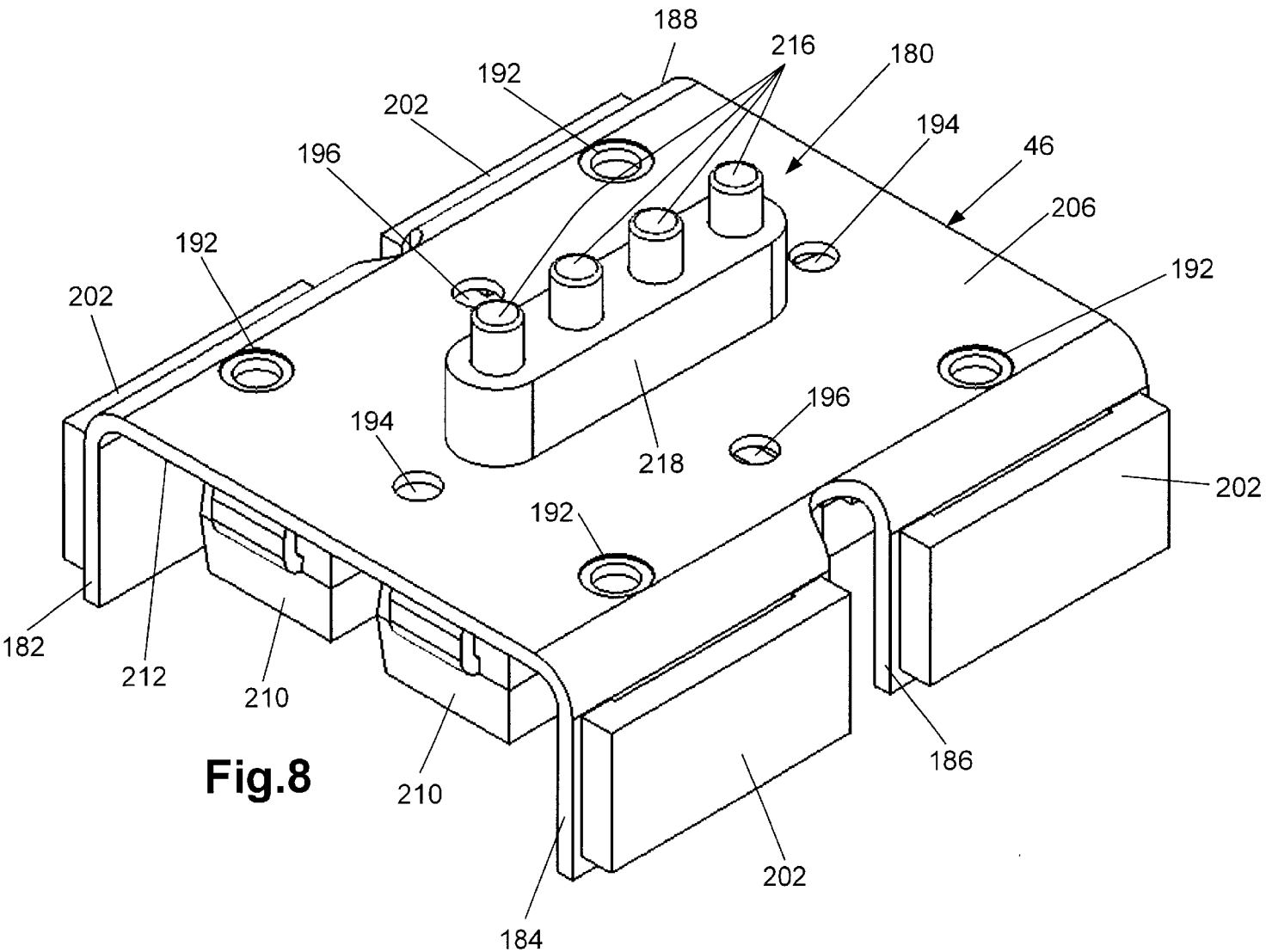
FIG. 8 is an upper pictorial view illustrating a printed circuit and electrical circuit components prior to installation of the printed circuit and electrical circuit components in the base of the push button assembly of FIGS. 2 and 3.

The metal conductors in the printed circuit 46 extend across the main section 180 and into the secondary sections 182–188. At least some of the metal conductors in the printed circuit 46 are connected with metal terminal rings 192 (FIG. 8). The terminal rings 192 telescopically receive and are connected with metal terminals 68 (FIGS. 3, 5 and 7). There are four metal terminal rings 192 which engage metal terminals 68 disposed at the four corners of the base 52 (FIG. 5).

In addition to the four corner terminals 68, there are two additional terminals. These terminals extend through openings 194 (FIG. 8) in the printed circuit 46 without making electrical contact with conductors in the printed circuit. Thus, the terminals 68 which extend through the openings 194 are free of electrically conductive connections with conductors in the printed circuit 46. The terminals 68 which extend through the openings 194 in the printed circuit 46 are electrically connected with the solid state light sources 42 by the rigid printed circuit board forming the light source board 44 (FIGS. 4 and 5). There are two additional openings 196 (FIG. 8) through which terminals associated with a push button assembly having a construction which differs from the construction of the push button assembly 40, may extend.

Electrical circuit components 48 are mounted on the secondary sections 182–188 of the printed circuit 46. In addition, electrical circuit components 48 are mounted on the main section 180 of the printed circuit 46. The location and construction of the electrical circuit components 48 may vary depending upon the environment in which the push button assembly 40 is used.

In the specific embodiment of the push button assembly illustrated in FIGS. 1–8, the electrical circuit components 48 include power resistors 202. The power resistors 202 are mounted on outwardly facing side surfaces of the secondary sections 182–188 of the printed circuit 46. The outwardly facing side surfaces on the secondary sections 182–188 of the printed circuit 46 are formed as a continuation of a flat upper side surface 206 on the main section 180 of the printed circuit 46. The upper side surface 206 on the printed circuit 46 extends perpendicular to the secondary sections 182–188 of the printed circuit.

In addition to the power resistors, the electrical circuit components 48 include a plurality of zener diodes 210 which are mounted on a flat lower side surface 212 of the main section 180 of the printed circuit 46. Although only two zener diodes 210 are clearly visible in FIG. 8, it should be understood that there are four zener diodes disposed beneath the main section 180 of the printed section 46. The zener diodes are positioned beneath the main section 180 of the printed circuit 46 and between the secondary sections 182–18 of the printed circuit.

Although the illustrated electrical circuit components 48 include power resistors 202 and zener diodes 210, other known electrical circuit components may be utilized. These known electrical circuit components may be used in place of the power resistors 202 and zener diodes 210 or may be used in addition to the power resistors and zener diodes. It is contemplated that the electrical circuit components may be arranged on the printed circuit 46 in a manner which is different than the manner illustrated in FIG. 8.

A plurality of rigid metal conductors 216 are disposed in a central portion of the printed circuit 46 (FIG. 8). The conductors 216 extend perpendicular to the upper side surface 206 of the main section 180 of the printed circuit 46 and are connected with the light source board 44 (FIGS. 4 and 5). A spacer 218, formed of an electrically insulating material, extends around the conductors 216. The spacer 218 maintains a desired space between the light source board 44 (FIGS. 4 and 5) and the printed circuit 46.

The printed circuit 46, with the electrical circuit components 48 mounted thereon, is positioned in the recess 50 (FIG. 7) in the base 52. When the printed circuit 46 is positioned in the recess 50 in the base 52, the power resistors 202 are positioned in flat abutting engagement with the panels 116 and 118 on the first section 112 of the heat sink 110 and in flat abutting engagement with the panels 150 and 152 on the second section 114 of the heat sink 110 (FIG. 6).

The base 52 includes an inner wall 222 (FIG. 7) which extends parallel to and is spaced from the side wall 60 of the base. The inner wall 222 intersects and extends perpendicular to the inner wall 126 in the base. The inner wall 222 engages the secondary sections 182 and 188 (FIG. 8) of the printed circuit 46 to position the power resistors 202 mounted on these secondary sections in flat abutting engagement with the panels 116 and 118 on the first section 112 of the heat sink 110. In addition, the inner wall 222 engages the zener diodes 210 which are adjacent to the secondary sections 182 and 188 of the printed circuit to position these zener diodes in the recess 50.

Although only the inner wall 222 is illustrated in FIG. 7, it should be understood that there is a corresponding inner wall adjacent to the side wall 56 of the base 52. The inner wall adjacent to the side wall 56 of the base extends parallel to the inner wall 222 and to the side wall 56. The inner wall which extends adjacent to the side wall 56 of the base engages the secondary sections 184 and 186 of the printed circuit 46 to position the power resistors 222 mounted thereon in flat abutting engagement with the panels 150 and 152 of the second section 114 of the heat sink 110.

In addition to the inner walls 126 and 222, the base 52 include a ledge 224 (FIGS. 6 and 7) which extends around the inside of the recess 50. The ledge 224 engages the light source board 44 (FIGS. 4 and 5) to support the light source board above the bottom wall 62 of the base 52. The light source board 44 is supported in a parallel spaced apart relationship with the main section 180 (FIG. 8) of the printed circuit 46 by the ledge 224.

The flat abutting engagement of the power resistors 202 with the panels 116, 118, 150 and 152 on the sections 112 and 114 of the heat sink 110 promotes heat transfer from the power resistors to the heat sink. Heat is transferred from the zener diodes 210 to the power resistors 202 through metal conductors (not shown) in the printed circuit 46. These metal conductors perform the dual function of conducting electrical energy between the zener diodes 210 and the power resistors 202 and of conducting heat from the zener diodes to the power resistors 202. This heat from the zener diodes 210 is transferred from the power resistors 202 to the heat sink 210.

Housing

In accordance with one of the features of the present invention, heat is conducted from the heat sink 110 to the metal housing 84 (FIGS. 2–5). The side wall 85 (FIG. 4) on the metal housing 84 engages the projections 132 and 134 (FIG. 6) on the first section 112 of the heat sink 110. Similarly, the side wall 87 (FIG. 4) on the metal housing 84 engages the projections 160 and 162 (FIG. 6) on the second section 114 of the heat sink 110.

Engagement of the metal heat sink projections 132, 134, 160 and 162 (FIG. 6) with the metal housing 84 (FIG. 4) results in heat being transmitted from the heat sink to the metal housing. The housing 84 is exposed to the environment around the push button switch assembly 20. Therefore, heat is transferred from the housing 84 to the environment and the housing is relatively cool. Of course, the metal housing 84 is substantially larger than the metal heat sink 110 and can absorb a greater amount of heat.

The heat sink projections 132, 134, 160 and 162 (FIG. 6) have downwardly (as viewed in FIG. 6) extending flanges 232. The flanges 232 extend generally parallel to the panels 116, 118, 150 and 152 on the sections 112 and 114 of the heat sink 110. However, the flanges 232 flare slightly outward away from the panels 116, 118, 150 and 152 on the sections 112 and 114 of the heat sink 110. This results in the flanges 232 being resiliently deflected inward toward the side walls 56 and 60 (FIGS. 6 and 7) of the base 52 by the housing side walls 85 and 87 as the housing 84 is telescopically moved downward (as viewed in FIG. 5) around the side walls 54, 56, 58, and 60 on the base 52.

The resilient deflection of the flanges 232 results in the flanges being firmly pressed against inner side surfaces on of the housing side walls 85 and 87. The pressure applied by the flanges 232 against the inner side surfaces of the housing side walls 85 and 87 ensures that there is solid engagement between the sections 112 and 114 of the heat sink 110 and the metal housing 84. This enables heat to be readily conducted from the sections 112 and 114 of the heat sink 110 to the metal housing 84. If desired, the sections 112 and 114 of the heat sink 110 may be sized so that there is an interference fit between the inner side surfaces of the housing side walls 85 and 87 and the flanges 232 on the projections 132, 134, 160, and 162. If this is done, the flanges 232 may extend perfectly parallel to the panels 116, 118, 150 and 152 of the sections 112 and 114 of the heat sink 110. This is because the interference fit would result in solid engagement of the metal flanges 232 with the metal housing 84.

In the embodiment of the push button 40 illustrated in FIGS. 1–8, the sections 112 and 114 of the heat sink are initially separate from the base 52. However, it is contemplated that the base 52 may be molded around the projections 132, 134, 160 and 162 (FIG. 6) from the sections 112 and 114 of the heat sink. If this is done, the outer side surfaces on the flanges 232 would be exposed for engagement with the metal housing 84. Similarly, the inner side surfaces of the panels 116, 118, 150 and 152 would be exposed for engagement with the power resistors 202. Molding the base 52 around the projections 132, 134, 160 and 162 would allow the flanges 232 to be extended in any desired direction to increase the extent of engagement of the flanges 232 with the metal housing 84.

During operation of an apparatus with which the push button switch assembly 20 is associated, such as an aircraft or other vehicle, the power resistors 202 emit heat. This heat is conducted directly to the panels 116, 118, 150 and 152 (FIG. 6) on the sections 112 and 114 of the heat sink 110. In addition, the zener diodes 210 (FIG. 8) emit heat.

Heat from the zener diodes 210 is conducted through the metal conductors disposed in the printed circuit 46 to the power resistors 202. The heat from the zener diodes is transmitted from the power resistors 202 to the panels 116, 118, 150 and 152 of the sections 112 and 114 of the heat sink 110 along with the heat emitted by the power resistors themselves. Thus, heat from both the zener diodes 210 and the power resistors 202 is transmitted to the heat sink 110.

The heat is transmitted from the projections 132, 134, 160 and 162 on the sections 112 and 114 of the heat sink 110 to the metal housing 84. The metal housing 84 has a relatively large, exterior surface exposed to the environment around the push button assembly 20 to enable heat transmitted to the housing to be dissipated. In addition, the housing 84 may absorb heat without becoming excessively hot.

It is contemplated that it may be desired to increase the area of contact of the heat sink 110 with the metal housing 84. This may be done by providing the heat sink 110 with additional sections, similar to the sections 112 and 114. These additional heat sink sections may be positioned in engagement with the zener diodes 210 and extend through openings, in the side walls 54 and 58 of the base 52. These additional openings in the side walls 54 and 58 would correspond to the openings 140, 142, 166, and 168 in the side walls 60 and 56 of the base 52.

It is also contemplated that the area of engagement between the heat sink 110 and the housing 84 may be increased by providing a metal band around the outside of the base 52. The metal band may extend completely around the base 52 and may be engaged by the projections 132, 134, 160 and 162 on the sections 112 and 114 of the heat sink 110. Alternatively, projections may extend inward from the metal band around the outside of the base into engagement with the sections 112 and 114 of the heat sink 110.

If desired, the metal band which extends around the outside of the base 52 may be connected with a metal band on the inside of the base by a plurality of metal pins which extend through the side walls 54–60 of the base 52. Rather than being connected between metal bands on the inside and/or outside of the base 52, the metal pins may have head end portions which engage the heat sink 110 and the housing 84.

Light Sources

The solid state light sources 42 are mounted on a light source board 44. The light source board 44 is a rigid printed circuit board which is connected with the conductors 216 (FIG. 8). If desired, electrical circuit components 236 (FIG. 5) may be mounted on the lower side of the light board 44.

A heat sink may be positioned adjacent to the electrical circuit components 236. If a heat sink is positioned adjacent to the electrical circuit components 236, it may have the same general construction as the heat sink 110 of FIG. 6. The heat sink associated with the electrical circuit components 236 may extend through openings in the side walls 56 and 60 of the base in the same manner as does the heat sink 110. Since the light source board 44 is disposed above the printed circuit 46, the heat sink for the electrical circuit components 236 disposed beneath the light source board 44 would be disposed above the heat sink 110. Alternatively, the heat sink associated with the electrical circuit components 236 may extend through openings in the side walls 54 and 58.

Rather than providing a separate heat sink for the electrical circuit components 236, it is contemplated that the panels 116, 118, 150, and 152 on the sections 112 and 114 of the heat sink 110 may be extended upward to a location adjacent to the electrical circuit components 236. If this is done, additional projections, corresponding to the projections 132, 134, 160 and 162 may be provided in association with a portion of the heat sink adjacent to the electrical circuit components 236. It should be understood that the electrical circuit components 236 may be omitted from some embodiments of the push button assembly 40.

The solid state light sources 42 are light emitting diodes (LED). However, other known solid state sources of light may be utilized if desired. The light sources 42 are arranged in groups on the light source board 44. The divider 76 separates the groups of light sources from each other and directs the light from any one group of light sources 42 toward an associated portion of the display 72. Therefore, only a portion of the display 72 may be illuminated. This would result in indicia on the illuminated portion of the display 72 being visible to personnel adjacent to the push button switch assembly 20. Indicia on portions of the display 72 which are not illuminated would not be visible.

Second Embodiment

Figure 9:
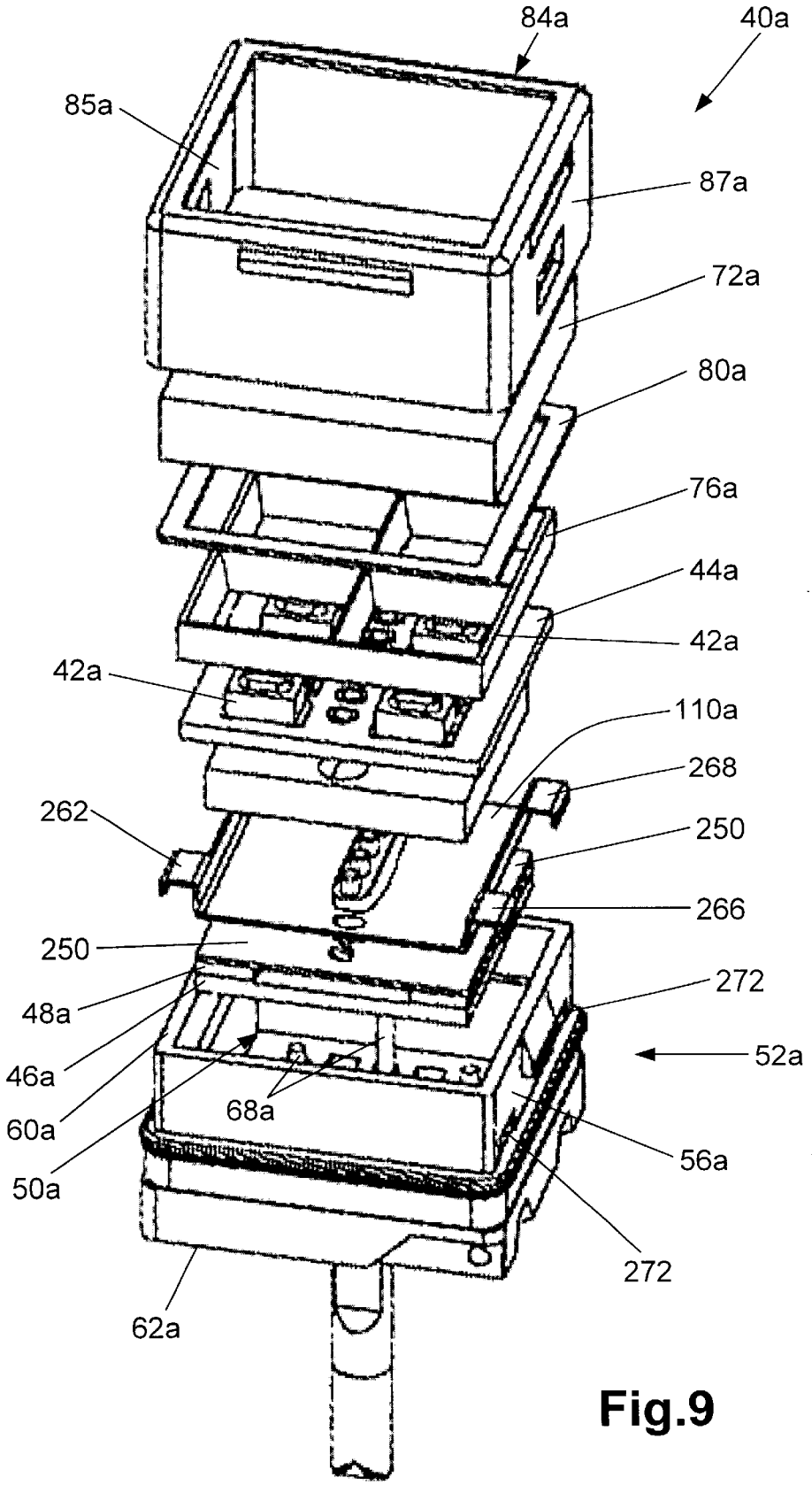
FIG. 9 is an exploded upper pictorial view, generally similar to FIG. 4, of a second embodiment of the push button assembly.
Figure 10:
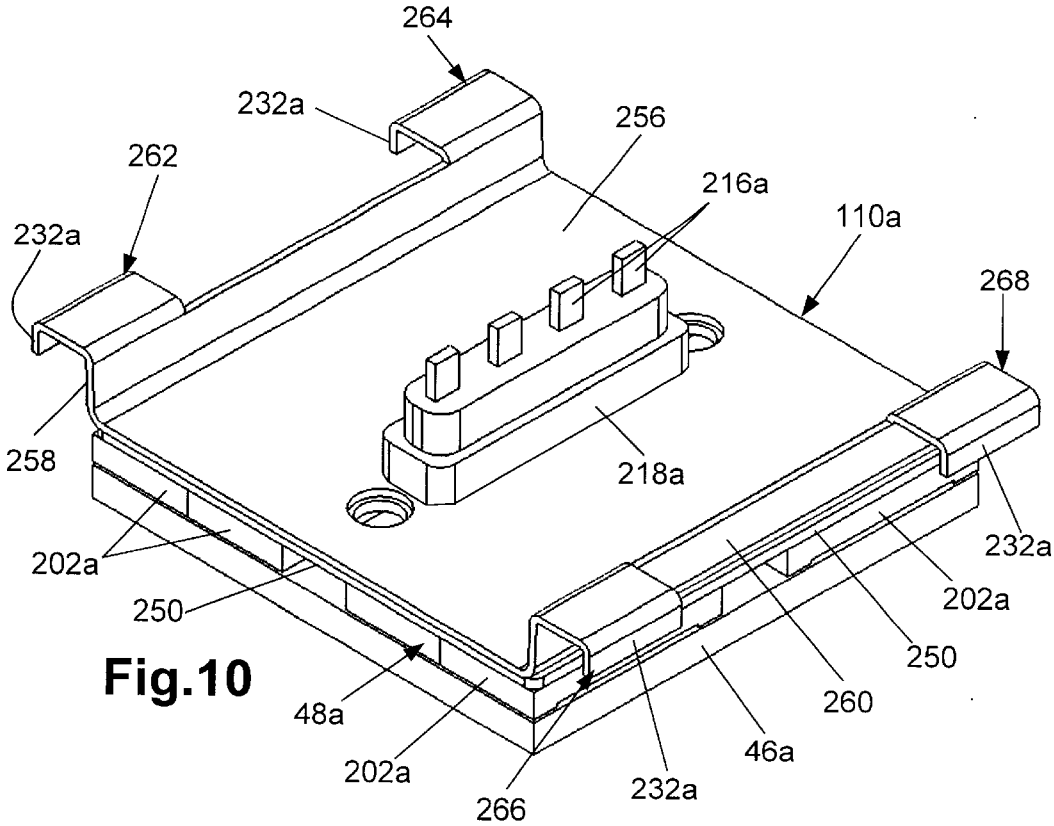
FIG. 10 is an upper pictorial view illustrating a heat sink utilized in the push button assembly of FIG. 9.
Figure 11:
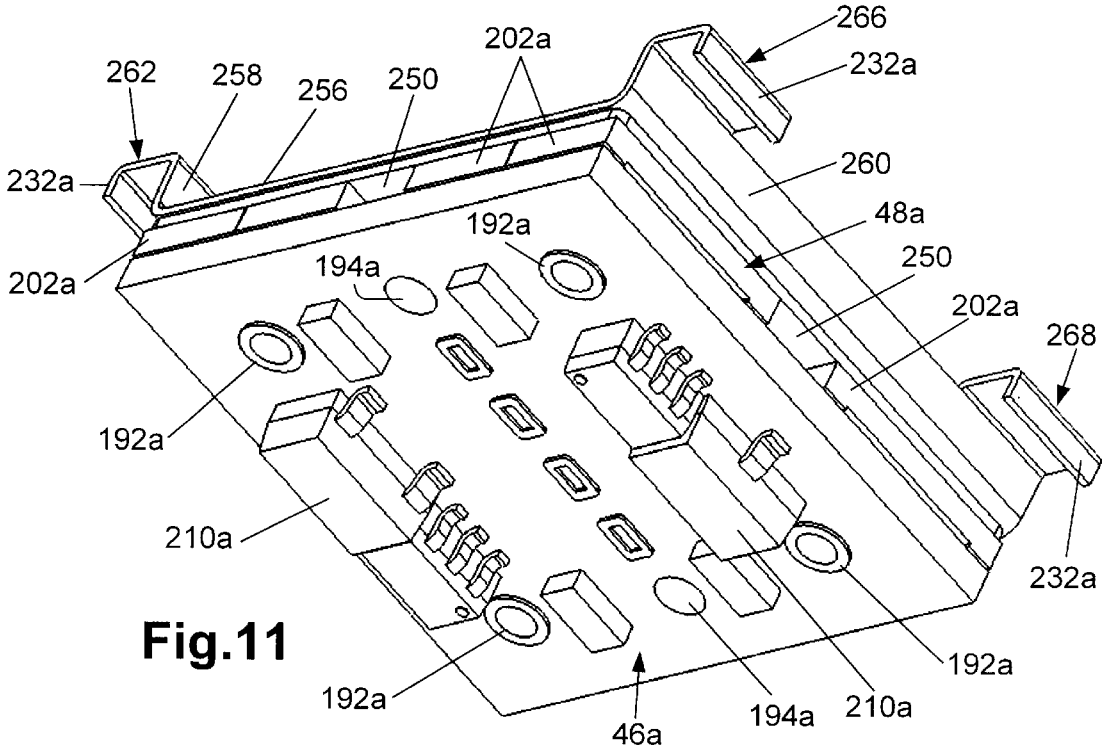
FIG. 11 is a lower pictorial view illustrating the relationship of the heat sink of FIG. 10 to a printed circuit and electrical circuit components.

In the embodiment of the push button assembly illustrated in FIGS. 2–8, the heat sink 110 is formed by two separate sections 112 and 114. In the embodiment of the invention illustrated in FIGS. 9–11, the heat sink is formed as one piece. Since the embodiment of the invention illustrated in FIGS. 9–11 is generally similar to the embodiment of the invention illustrated in FIGS. 1–8, similar numerals will be utilized to designate similar components, the suffix letter "a" being associated with the numerals of FIGS. 9–11 to avoid confusion.

A push button assembly 40*a* (FIG. 9) includes a base 52*a* which is formed of a suitable electrically insulating polymeric material. A rigid printed circuit 46*a* is received in a generally rectangular recess 50*a* formed a base 52*a*. Metal terminals 68*a* extend through a bottom wall 62*a* of the base 52*a* into the recess 50*a* and engage the printed circuit 46*a*. Electrical circuit components 48*a* (FIGS. 9–11) are disposed on the printed circuit 46*a*.

Electrical circuit components 48*a* include power resistors 202*a* which are disposed on the upper (as viewed in FIGS. 10 and 11) side of the rigid printed circuit 46*a*. In addition, the electrical circuit components 48*a* include zener diodes 210*a* (FIG. 11) which are disposed on the lower side of the printed circuit 46*a*.

The printed circuit 46*a* includes a plurality of terminal rings 192*a* which telescopically receive terminal 68*a* and are electrically connected with conductors in the printed circuit 46*a*. In addition, openings 194*a* extend through the printed circuit 46*a* and are not connected with conductors contained in the printed circuit. The printed circuit 46*a* is a rigid board which is not flexible.

The electrical circuit components 48*a* emit heat. This heat is transmitted to a heat sink 110*a* (FIG. 10). The heat sink 110*a* is formed of a single piece of sheet metal. The metal heat sink 110*a* is electrically insulated from the power resistors 202*a* by a layer 250 of electrically insulating and thermally conductive foam.

The metal heat sink 110*a* includes a flat main panel 256. A pair of end panels 258 and 260 extend perpendicular to the main panel 256 and parallel to each other. Projections 262 and 264 extend from the end panel 258. Similarly, projections 266 and 268 extend from the end panel 260. The projections 262–268 extend through openings, similar to the openings 272, in side walls 56*a* and 60*a* in the base 52*a* (FIG. 9). The main panel 256, end panels 258 and 260, and the projections 262–268 are integrally formed as one piece of metal.

The projections 262–268 have flanges 232*a* (FIGS. 10 and 11). The flanges 232*a* extend along the outside of the side walls 60*a* and 62*a* of the base 52*a*. The projections 262–268 are engagable by a metal housing 84*a* (FIG. 9). The metal projections 262–268 engage inner side surfaces of metal side walls 85*a* and 87*a* of the housing 84*a*.

Heat emitted by electrical circuit components 48*a* is conducted from the main panel 256 of the heat sink 110*a* to the projections 262–268. The flanges 232*a* on the projections 262–268 are engaged by the metal housing 84*a*. The heat is transmitted from the metal housing 84*a* to the environment around the push button assembly 40*a*.

Conductors 216*a* extend from the printed circuit 46*a* through the layer 250 of electrically insulating and thermally conductive foam and through the heat sink 110*a* to a light source board 44*a*. A spacer 218*a* (FIG. 10) is provided to separate the rigid light source board 44*a* (FIG. 9) from the heat sink 110*a*. The spacer 218*a* is formed of an electrically insulating material.

Solid state light sources 42*a* (FIG. 9) are disposed on the light source board 44*a*. The solid state light sources 42*a* are light emitting diodes (LED). However, it is contemplated that other types of solid state light sources may be utilized if desired.

A divider 76*a* is provided between the light source printed circuit board 44*a* and a display 72*a*. A gasket 80*a* prevents light from leaking between the divider 76*a* and the display 72*a*. The metal housing 84*a* encloses the display 72*a* and telescopically receives the upper end portion of the base 52*a*.

The zener diodes 210*a* (FIG. 11) are disposed beneath the rigid board forming the printed circuit 46*a*. It may be desired to provide a separate heat sink adjacent to the lower side of the printed circuit 46. The heat sink provided adjacent to the lower side of the printed circuit may be constructed in two separate sections, similar to the sections 112 and 114 of the heat sink 110 (FIG. 6). Although it may be preferred to provide the sections of the heat sink adjacent to the lower side of the printed circuit with projections which extend through side walls of the base 52*a* (FIG. 9), these projections may be omitted if desired. Alternatively, the sections of the heat sink adjacent to the lower side of the printed circuit 46*a* may be connected with the heat sink 110*a*.

CONCLUSION

In view of the foregoing description, it is apparent that the present invention provides a new and improved push button assembly 40 which is used to move switch contacts 30 between an actuated condition and an unactuated condition. The push button assembly 40 includes a plurality of solid state light sources 42 which are energizable to emit light. A display 72 is illuminated by light from the solid state light sources 42 when the solid state light sources are energized.

A metal heat sink 110 is disposed adjacent to electrical circuit components 48 which emit heat. To conduct heat away from the heat sink 110, the metal heat sink may be disposed in engagement with a metal housing 84. The heat sink 110 may be formed by a single member or by a plurality of members. The members 112 and 114 forming the heat sink 110 may advantageously have projections 132, 134, 160 and 162 which extend through side walls 56 and 60 of a base 52. The projections 132, 134, 160 and 162 are engagable by the metal housing 48 to facilitate the conduction of heat between the heat sink 110 and the housing.

Having described the invention, the following is claimed:

1. A push button assembly for use with switch contacts which are movable between an actuated condition and an unactuated condition, said push button assembly comprising a base formed of an electrically insulating material, a printed circuit at least partially enclosed by said base, a plurality of solid state light sources connected with said printed circuit, said solid state light sources being energizable to emit light, a display which is illuminated by light from said solid state light sources when said solid state light sources are energized, a metal housing which partially encloses said display, a plurality of electrical circuit components which are connected with said printed circuit and which emit heat, and a metal heat sink disposed adjacent to said electrical circuit components to conduct heat away from said electrical circuit components, said metal heat sink being disposed in engagement with said metal housing to enable heat to be conducted from said metal heat sink to said metal housing.

2. A push button assembly as set forth in claim 1 wherein said heat sink includes a plurality of metal projections each of which extends through said base into engagement with said metal housing.

3. A push button assembly as set forth in claim 1 wherein said metal housing includes a plurality of openings which are engaged by retainers extending from base to interconnect said base and said metal housing.

4. A push button assembly as set forth in claim 1 further including an actuator member extending from said base in a direction away from said display to transmit force to move the switch contacts between the actuated condition and the unactuated condition.

5. A push button assembly as set forth in claim 1 wherein said base includes a plurality of side walls which at least partially define a recess in which said printed circuit is at least partially disposed, said metal housing having a plurality of side walls which extend along said side walls of said base, said heat sink extends through at least one of said side walls of said base into engagement with at least one of said side walls of said metal housing.

6. A push button assembly as set forth in claim 5 wherein a portion of said heat sink is disposed between an outer surface on one of said side walls of said base and an inner surface on one of said side walls of said metal housing.

7. A push button assembly as set forth in claim 6 wherein a portion of said heat sink extends along an inner surface on one of said side walls of said base.

8. A push button assembly as set forth in claim 5 wherein said heat sink extends across said recess and extends through side walls on opposite sides of said base into engagement with opposite side walls of said metal housing.

9. A push button assembly as set forth in claim 8 wherein said heat sink has a first side surface which faces toward said solid state light sources and a second side surface which faces away from said solid state light sources, said electrical circuit components being at least partially disposed between said second side surface of said heat sink and a bottom of said recess.

10. A push button assembly as set forth in claim 9 wherein said printed circuit is at least partially disposed between said second side surface of said heat sink and the bottom of said recess.

11. A push button assembly as set forth in claim 5 wherein said printed circuit has a first portion which extends along a first one of said side walls of said base, a second portion which extends along a second one of said side walls of said base and a third portion which extends between said first and second portions of said printed circuit, said heat sink having a first portion which is disposed adjacent to said first portion of said printed circuit and a second portion which is disposed adjacent to said second portion of said printed circuit.

12. A push button assembly as set forth in claim 11 wherein at least a portion of said electrical circuit components are disposed between said first portion of said printed circuit and said first portion of said heat sink and at least a portion of said electrical circuit components are disposed between said second portion of said printed circuit and said second portion of said heat sink.

13. A push button assembly as set forth in claim 12 wherein said first portion of said heat sink is disposed between said first portion of said printed circuit and said first one of said side walls of said base, said second portion of said heat sink is disposed between said second portion of said printed circuit and said second one of said side walls of said base.

14. A push button assembly for use with switch contacts which are movable between an actuated condition and an unactuated condition, said push button assembly comprising a base, said base having a plurality of side walls, said plurality of side walls include first and second side walls, a printed circuit, said printed circuit includes a first portion which extends along said first side wall of said base, a second portion which extends along said-second side wall of said base and a third portion which extends between said first and second portions of said printed circuit, a plurality of solid state light sources connected said printed circuit, said solid state light sources being energizable to emit light, a first electrical circuit component which is connected with said printed circuit and is disposed between said first portion of said printed circuit and said first side wall of said base, a second electrical circuit component which is connected with said printed circuit and is disposed between said second portion of said printed circuit and said second side wall of said base, a first metal heat sink disposed between said first electrical circuit component and said first side wall of said base, and a second metal heat sink disposed between said second electrical circuit component and said second side wall of said base.

15. A push button assembly as set forth in claim 14 further including a third electrical circuit component disposed between said first and second portions of said printed circuit and connected with at least one of said first and second electrical circuit components by a metal electrical conductor which extends from said third portion of said printed circuit to at least one of said first and second electrical circuit components, said metal electrical conductor being effective to conduct heat from said third portion of said printed circuit.

16. A push button assembly as set forth in claim 14 further including a first terminal which extends from said base and is connected with an electrical conductor in said third portion of said printed circuit and a second terminal which extends from said base and extends through said third portion of said printed circuit, said second terminal being free of electrically conductive connections with conductors in said third portion of said printed circuit at a location where said second terminal extends through said third portion of said printed circuit, said third terminal being electrically connected with at least one of said solid state light sources at a location spaced from conductors in said third portion of said printed circuit.

17. A push button assembly as set forth in claim 14 wherein said first and second portions of said printed circuit having major side surfaces which extend generally perpendicular to a major side surface of said third portion of said printed circuit, said first heat sink having a major side surface which is spaced apart from and extends generally parallel to the major side surface of said first portion of said printed circuit, said second heat sink having a major side surface which is spaced apart from and extends generally parallel to the major side surface of said second portion of said printed circuit.

18. A push button assembly as set forth in claim 17 wherein said major side surface of said first heat sink is disposed in engagement with said first side wall of said base, said major side surface of said second heat sink being disposed in engagement with said second side wall of said base.

19. A push button assembly as set forth in claim 14 further including a light source board having a first and second side surfaces, said first side surface of said light source board faces toward said third portion of said printed circuit and said second side surface of said light source board faces away from said third portion of said printed circuit, said plurality of solid state light sources being disposed adjacent to said second side of said light source board.

20. A push button assembly as set forth in claim 19 wherein said first side of said light source board is spaced apart from and extends generally parallel to said third portion of said printed circuit, said push button assembly further includes a plurality of electrical conductors which extend between said light source board and said third portion of said printed circuit.

21. A push button assembly as set forth in claim 19 wherein said base includes a plurality of surfaces which engage said first side surface of said light source board to position said light source board relative to said base.

22. A push button assembly as set forth in claim 19 further including a divider disposed adjacent to said second side of said light source board to divide said plurality of solid state light sources into a plurality of groups, and a display which is illuminated by light from said solid state light sources when said solid state light sources are energized, said divider being effective to direct light from a first group of said solid state light sources toward a first portion of said display and to block transmission of light from the first group of light sources toward portions of said display other than the first portion of said display when the first group of said solid state light sources is energized.

23. A push button assembly as set forth in claim 14 wherein said base includes a first positioning surface which engages a first side of said first portion of said printed circuit, said first side wall of said base having an inner side surface which engages said first heat sink, said first portion of said printed circuit, said first electrical circuit component and said first heat sink being at least partially disposed between said first positioning surface and said inner side surface of said first side wall of said base, said base includes a second positioning surface which engages a first side of said second portion of said printed circuit, said second side wall of said base having an inner side surface which engages said second heat sink, said second portion of said printed circuit, said second electrical circuit component and said second heat sink being at least partially disposed between said second positioning surface and said inner side of said second side wall of said base.

24. A push button assembly as set forth in claim 14 wherein said first heat sink includes a projection which extends into an opening in said first side wall of said base in a direction away from said first portion of said printed circuit, said second heat sink includes a projection which extends into an opening in said second side wall of said base in a direction away from said second portion of said printed circuit.

25. A push button assembly as set forth in claim 14 further including a display which is illuminated by light from said solid state light sources when said solid state light sources are energized, and a metal housing which partially encloses said display, said first and second heat sinks being disposed in engagement with said metal housing to enable heat to be conducted from said first and second heat sinks to said metal housing.

26. A push button assembly for use with switch contacts which are movable between an actuated condition and an unactuated condition, said push button assembly comprising a base, said base having a plurality of side walls which extend from a bottom wall, a printed circuit which is at least partially enclosed by said base, said printed circuit having a first surface which faces toward said bottom wall of said base and a second surface which faces away from said bottom wall of said base, an electrical circuit component which is connected with said printed circuit and which emits heat, said electrical circuit component being disposed adjacent to said second side of said printed circuit, a plurality of solid state light sources connected with said printed circuit, said solid state light sources being energizable to emit light, and a metal heat sink disposed between said plurality of solid state light sources and said electrical circuit component.

27. A push button assembly as set forth in claim 26 further including a plurality of electrical conductors extending from said printed circuit through said heat sink to said solid state light sources to conduct electrical energy when said solid state light sources are energized.

28. A push button assembly as set forth in claim 26 further including a foam pad formed of electrically insulating and heat conductive material disposed between said heat sink and said electrical circuit component.

29. A push button assembly as set forth in claim 26 wherein said heat sink has a first side surface which faces toward and extends generally parallel to said second side surface of said printed circuit.

30. A push button assembly as set forth in claim 26 wherein said heat sink includes a first projection which extends into an opening in a first side wall of said plurality of side walls and a second projection which extends into an opening in a second side wall of said plurality of side walls.

31. A push button assembly as set forth in claim 26 wherein said first side of said printed circuit extends across said bottom wall, said heat sink having a side surface which faces toward said second surface on said printed circuit and which extends across said second surface on said printed circuit.

32. A push button assembly as set forth in claim 26 further including a light source board having first and second side surfaces, said first side surface of said light source board faces toward said heat sink and said second side surface of said light source board faces away from said heat sink, said plurality of light sources being disposed adjacent to said second side of said light source board.

33. A push button assembly as set forth in claim 32 wherein said first side surface on said light source board is spaced apart from and extends generally parallel to a major side surface of said heat sink and a major side surface of said printed circuit.

34. A push button assembly as set forth in claim 32 further including a plurality of conductors which extend from said printed circuit through said heat sink to said light source board.

35. A push button assembly for use with switch contacts which are movable between an actuated condition and an unactuated condition, said push button assembly comprising a base formed of an electrically insulating material, said base having a bottom wall and a plurality of side walls which extend from said bottom wall and cooperate with said bottom wall to at least partially form a recess, a plurality of electrically conductive terminals connected with said bottom wall of said base, an electrical circuit component which emits heat and is disposed in said recess, said electrical circuit component being connected with at least one of said terminals to enable electrical energy to be conducted between at least one of said terminals and said electrical circuit component, a metal heat sink at least partially disposed in said recess, said electrical circuit component being disposed between said heat sink and said bottom wall of said base, said heat sink includes a metal plate portion which extends between first and second side walls of said plurality of side walls of said base, said heat sink includes a first plurality of metal projections which extend through said first side wall of said base and a second plurality of metal projections which extend through said second side wall of said base, a light source board which is disposed in said recess in said base, said heat sink being disposed between said light source board and said electrical circuit component, said light source board having an inner side which extends generally parallel to and faces toward said plate portion of said heat sink and an outer side which faces away from said heat sink, a plurality of solid state light sources connected with said light source board, said solid state light sources being energizable to emit light, a plurality of electrical conductors connected with said electrical circuit component and said solid state light sources to conduct electrical energy when said solid state light sources are energized to emit light, a display which is illuminated by light from said solid state light sources when said solid state light sources are energized, and a metal housing which partially encloses said display, said first and second pluralities of metal projections being disposed in engagement with said metal housing to enable heat to be conducted from said heat sink to said metal housing.

36. A push button assembly as set forth in claim 35 wherein said plurality of electrical conductors extend through an opening in said heat sink.

37. A push button assembly as set forth in claim 36 wherein the opening through which said plurality of conductors extend is disposed in a central portion of said heat sink.

38. A push button assembly as set forth in claim 35 further including a printed circuit connected with said terminals and with said electrical circuit component.

39. A push button assembly as set forth in claim 38 wherein said printed circuit is disposed between said bottom wall of said base and said heat sink.

* * * * *